US007627970B2

(12) United States Patent
Berteau

(10) Patent No.: US 7,627,970 B2
(45) Date of Patent: Dec. 8, 2009

(54) HANGER

(76) Inventor: Michel Berteau, 44 des Roses, St-Jean-sur-Richelieu (CA) J2W1R1

( * ) Notice: Subject to any disclaimer, the term of this patent is extended or adjusted under 35 U.S.C. 154(b) by 0 days.

(21) Appl. No.: 11/827,739

(22) Filed: Jul. 13, 2007

(65) Prior Publication Data

US 2009/0013575 A1 Jan. 15, 2009

(51) Int. Cl.
*G09F 7/22* (2006.01)

(52) U.S. Cl. ..... 40/617; 40/607.03; 248/216.1

(58) Field of Classification Search ..... 40/617, 40/607.03, 607.05, 664, 668, 661.11; 292/137; 248/216.1, 217.3
See application file for complete search history.

(56) References Cited

U.S. PATENT DOCUMENTS 3,115,225 A * 12/1963 Fraylick et al. ..... 52/716.7
3,494,244 A * 2/1970 Wayland ..... 411/510
3,719,342 A * 3/1973 Kupersmit ..... 248/216.1
4,149,329 A * 4/1979 Graves ..... 40/668
D293,880 S * 1/1988 Takahashi ..... D8/354
4,728,237 A * 3/1988 Lorincz et al. ..... 411/451.5
4,776,739 A * 10/1988 Hamman ..... 411/510
D300,116 S * 3/1989 Samson et al. ..... D8/367
4,831,760 A * 5/1989 Walker ..... 40/620
D319,474 S * 8/1991 Steiner ..... D20/22
5,810,242 A * 9/1998 Cahill et al. ..... 229/117.25
6,226,911 B1 * 5/2001 Wescombe ..... 40/668
2002/0121033 A1 * 9/2002 Hildyard et al. ..... 40/586
2007/0146143 A1 * 6/2007 Cote et al. ..... 340/572.8

* cited by examiner

*Primary Examiner*—Lesley D Morris
*Assistant Examiner*—Christopher E Veraa
(74) *Attorney, Agent, or Firm*—Eric Fincham

(57) ABSTRACT

A hanger for fluted polypropylene board has head and a shaft, the shaft having at least one barb extending outwardly therefrom. A variation of the hanger for a foam board comprises a head and a shaft with the shaft having a screw thread located thereon, the screw thread stopping short of a tip portion of the shaft.

8 Claims, 3 Drawing Sheets

HANGER

FIELD OF THE INVENTION

The present invention relates to hangers and more particularly, relates to hangers suitable for use with certain types of plastic signs and also to a method for hanging certain types of plastic signs.

BACKGROUND OF THE INVENTION

Signs are universally employed for displaying desired information and the types of signs and material used for their manufacture are numerous. Plastic has become widely used for certain types of signs since it has many desirable properties such as being lightweight, resistant to weather elements outside, and attractive. Two types of plastic signs which have received a wide degree of acceptance are fluted polypropylene board and foam board. Both of these materials have the advantage of being economic and extremely lightweight. They are very cost-effective and suitable for many different types of applications. They may be used outdoors as they will not rot or swell.

Fluted polypropylene board is well known in the art and is often referred to by the term "COROPLAST" which is a registered trademark. Such material has often also been referred to as Corex. In both instances, the material comprises first and second layers of plastic material having ribs or corrugations extending in a parallel manner interiorly between the first and second layers.

Foam board is another material used for display purposes. It is also known as foam core and is usually made by two sheets of plastic forming a sandwich about a Styrofoam center.

Both of the above materials, as above mentioned, are often used exteriorly due to their weather resistant properties. When used as a sign, means must be found to attach the same and frequently this is done by poking holes in the material and using a flexible material (wire, string, etc.) to hang the sign.

SUMMARY OF THE INVENTION

It is an object of the present invention to provide novel hangers for hanging both fluted polypropylene board and foam board.

It is a further object of the present invention to provide a method for hanging foam board and fluted polypropylene board.

According to one aspect of the present invention, there is provided a hanger comprising a head and a shaft, the shaft having at least one barb extending outwardly therefrom.

According to a further aspect of the present invention, there is also provided a hanger comprising a head and a shaft, a proximal end of the shaft being located adjacent the head, a distal end of the shaft being located remote from the head, the distal end having a tip portion with a generally V-shaped configuration, and a screw thread located on the shaft, the screw thread extending from the proximal end to a point spaced from the tip portion.

In a still further aspect of the present invention, there is provided a method for hanging a foam board sign, the method comprising the steps of supplying a hanger member comprising a head and a shaft, a proximal end of the shaft being located adjacent the head, a distal end of the shaft being located remote from the head, the distal end having a tip portion with a generally V-shaped configuration, and a screw thread located on the shaft, the screw thread extending from the proximal end to a point spaced from the tip portion, and screw threadedly inserting the shaft into a foam portion of the foam board.

In a still further aspect of the present invention, there is provided a sign and hanger combination, the sign being a fluted board having first and second faces, a plurality of ribs extending between the first and second faces, the hanger comprising a handle and a shaft, the shaft having at least one barb extending outwardly therefrom, the barb engaging at least one of the ribs to thereby support the sign by the engagement.

In one embodiment of the present invention, and as aforementioned, the hanger comprises a head and a shaft with the shaft having at least one barb extending outwardly therefrom. Preferably, there are two rows of barbs, the barbs being symmetrically arranged with each barb having a generally V-shaped configuration. The barb thus has an upper wall which slopes downwardly from the tip of the barb to the central portion of the shaft.

Any number of barbs may be supplied in each row of the same and generally, between two and five barbs are utilized. For many purposes, a single barb on each side could be utilized though it is preferred that at least two such barbs be present on each side.

The spacing between the tips of the barbs may vary depending upon the particular structure of the fluted board. In fact, it is found that a spacing of between 2.5 and 7.5 mm may be utilized with a preferred embodiment utilizing spacing of approximately 5 mm.

The head of the hanger may have many different configurations. Thus, the head may be a solid piece of a material with an aperture extending therethrough or alternatively, the head could have an inverted hook like configuration such that it could be used to hang the sign from eyes inserted in a support structure.

Though the hanger may be constructed of many different materials, a plastic material is preferable.

In a further aspect of the present invention, there is provided a hanger for a foam board which, as mentioned above, has a threaded shaft. The threaded shaft is distinct from other threaded shafts in that it only extends for a portion of the shaft and terminates short of the tip portion. Typically, a screw having a thread thereon has the thread extending completely to the tip of the shaft.

It has been found that the above arrangement permits the insertion of the tip portion (which has a V-shaped configuration) with a continued pushing until the thread starts to bite into the foam material. A conventional threading motion may then be utilized.

The shaft also preferably has a slightly tapered configuration to provide a greater holding power. Thus, as the shaft is screw threadedly engaged with the foam, all portions of the thread will exert a greater force with this arrangement.

BRIEF DESCRIPTION OF THE DRAWINGS

Having thus generally described the invention, reference will be made to the accompanying drawings illustrating embodiments thereof, in which.

DETAILED DESCRIPTION OF THE INVENTION

Figure 1:
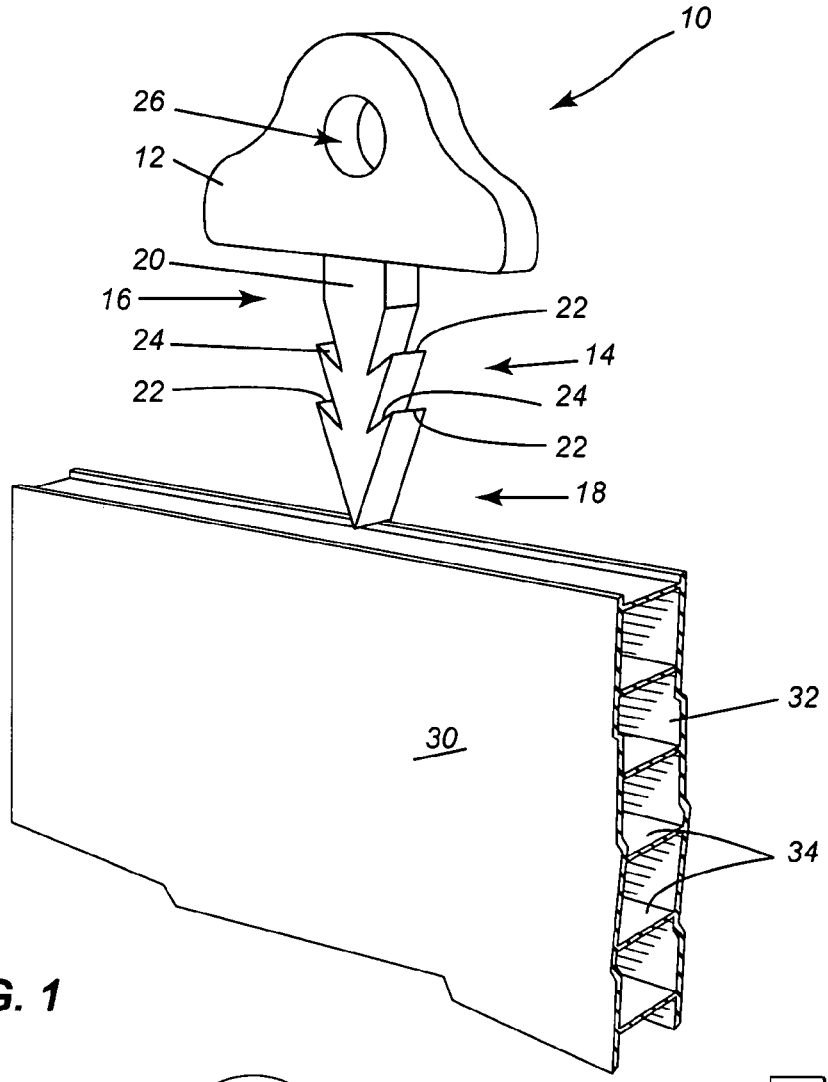
FIG. 1 is a perspective view of a hanger being inserted into a fluted board.
Figure 2:
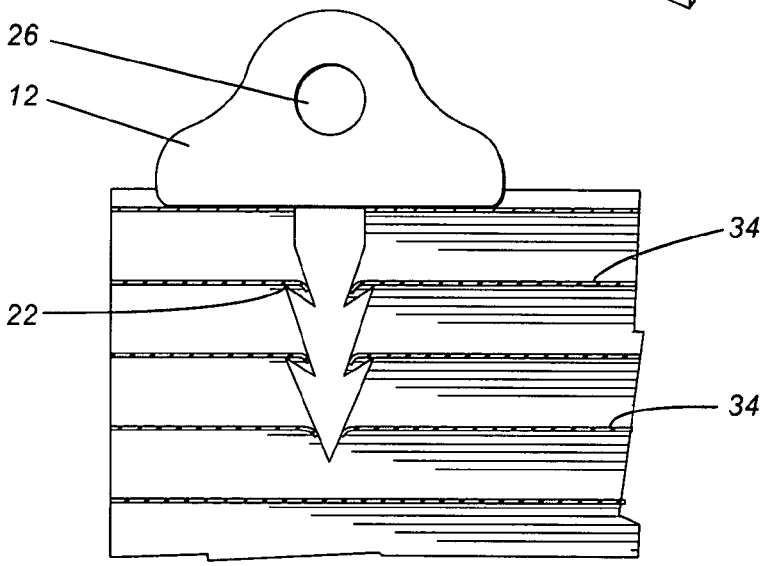
FIG. 2 is a sectional view illustrating the hanger having been inserted into the fluted board.
Figure 3:
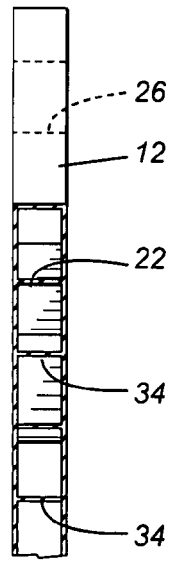
FIG. 3 is a end elevational view thereof.

Referring to the drawings in greater detail and by reference characters thereto, there is illustrated in FIGS. 1 to 3 a first embodiment of a hanger according to the present invention and which hanger is generally designated by reference numeral 10.

Hanger 10 has a head 12 and a shaft generally designated by reference numeral 14. Shaft 14 has a proximal end 16 which is adjacent head 12 and a distal end 18.

Shaft 14 has a central body portion 20 with a plurality of barbs 22 extending outwardly therefrom. As may be seen in FIGS. 1 and 2, barbs 22 are symmetrically arranged with two such barbs located on each side of central body 20. Each barb 22 is partially defined by an inwardly sloping wall 24 and has a generally V-shaped configuration.

Head 12 includes an aperture 26 which will be used to receive a cord or the like for purposes of hanging the fluted board. In this respect, head 12 may be of any suitable configuration and could, for example, merely be a hook like member.

As shown in FIGS. 1 and 2, a fluted board 28 has a front wall 30, a rear wall 32, with a plurality of ribs 34 extending therebetween.

Hanger 10 is inserted into fluted board 28 perpendicular to ribs 34. The sharp end of shaft 14 will pierce the ribs 34 and the shaft is then fully inserted. As may be seen in FIG. 2, barbs 22 will engage with ribs 34 to prevent withdrawal of hanger 10. Preferably, the spacing between the tips or barbs 22 are substantially equal to the spacing between ribs 34.

Figure 4:
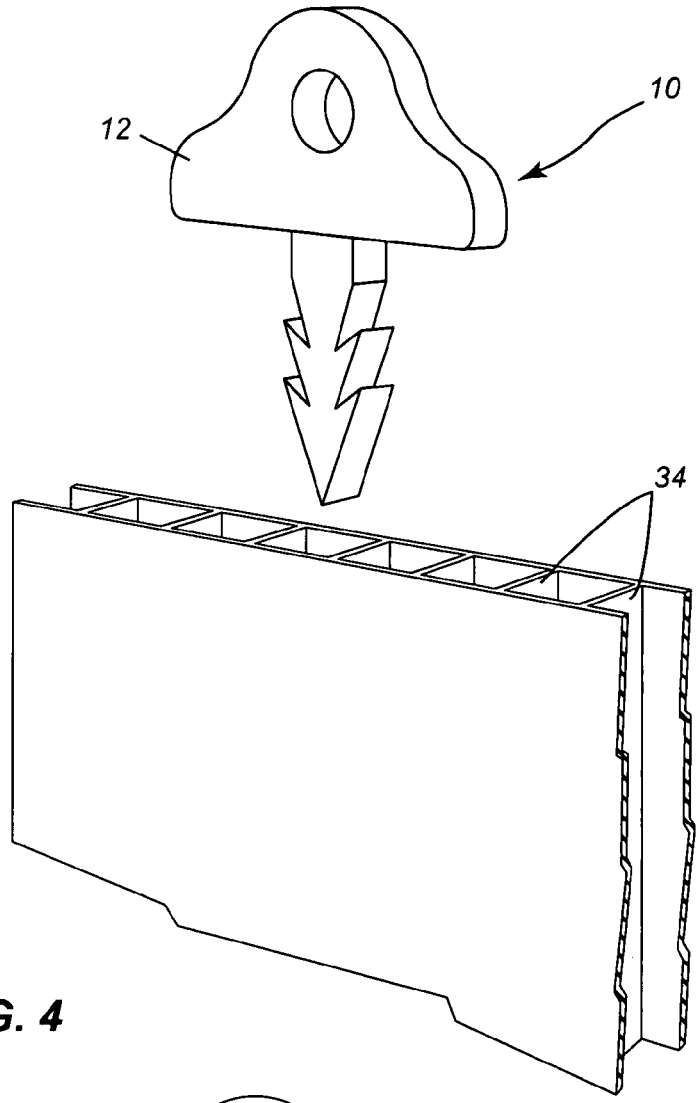
FIG. 4 is a perspective view illustrating the hanger about to be inserted into a fluted board from the other direction.
Figure 5:
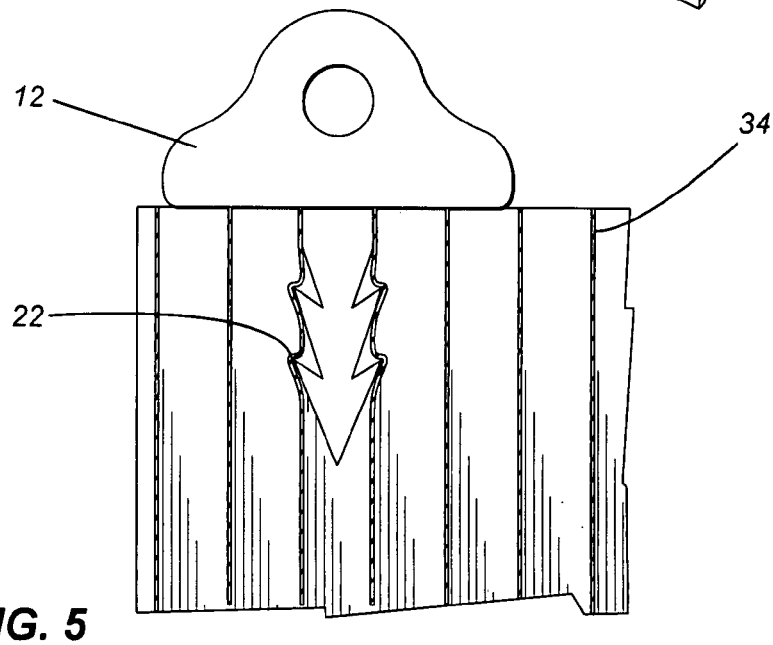
FIG. 5 is a cross-sectional view of the hanger having been inserted into the fluted board.

As shown in FIGS. 4 and 5, hanger 10 may also be inserted with shaft 14 being parallel to ribs 34. As seen in FIG. 5, barbs 22 will engage ribs 34 to provide an excellent gripping power.

Figure 6:
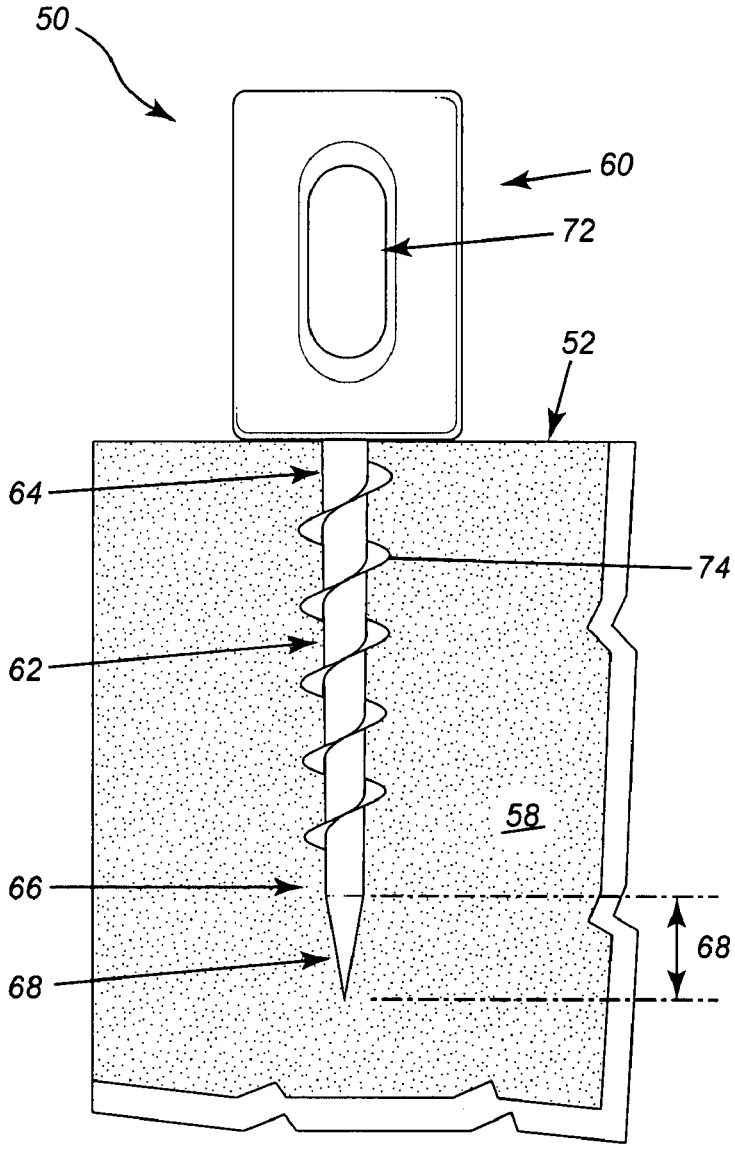
FIG. 6 is a cross-sectional view illustrating a further embodiment of a hanger according to the present invention inserted in a foam board.
Figure 7:
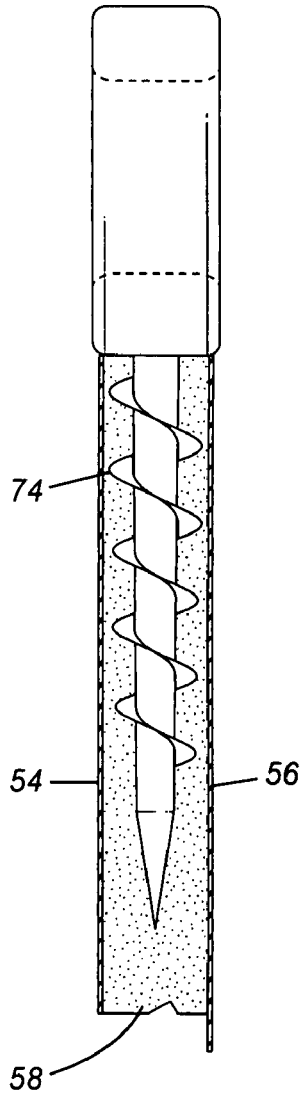
FIG. 7 is a end sectional view thereof.

In the embodiment of FIGS. 6 and 7, there is provided a hanger generally designated by reference numeral 50 and which is adapted to be used with foam board 52. Foam board 52, as is conventional, includes a front face 54, a rear face 56, and a foam center 58.

Hanger 50 again includes a head 60 with a shaft 62. Shaft 62 has a proximal end 64 adjacent head 60 and a distal end 66. At the distal end 66, there is provided a tip portion 68. Tip portion 68 is V-shaped to provide a penetrating tip.

Shaft 62 has a thread 74 thereon. It will be noted that thread 74 terminates short of tip portion 68. Shaft 62 is also tapered and has a larger diameter at the proximal end 64 compared to distal end 66.

A shown in FIGS. 6 and 7, hanger 50 is inserted into foam center 58 of foam board 52 using a turning motion as is conventional with screws. A flexible member such as a cord may be inserted through aperture 72 provided in head 60. As in the previously described embodiment, head 60 may assume many different configurations as is known in the art.

It is important that thread 74 not extend the full length of shaft 62. If a conventional screw like configuration were utilized, there would be substantial danger of the distal end of shaft 62 engaging either front face 54 or rear face 56 and forming a hole therein. The configuration as shown prevents such an occurrence.

It will be understood that the above described embodiments are for purposes of illustration only and that changes and modifications may be made thereto without departing from the spirit and scope of the invention.

I claim:

1. A sign and a hanger combination, said sign comprising;

first and second layers of a plastic material, a plurality of parallel ribs extending between said first and second layers of plastic material to thereby form a plurality of parallel channels between said first and second layers;

at least one hanger comprising a bead and a shaft, said shaft having at least first and second barbs extending outwardly therefrom, said first and second barbs being located on opposite sides of said shaft, said shaft being inserted in said board such that said shaft and barbs pierce through at least one of said ribs, said hanger being supported by an upper side of said barbs engaging one of said pierced ribs.

2. The combination of claim 1 wherein said shaft has third and fourth barbs protruding from opposite sides of said shaft and each of said first, second, third and fourth barbs having a substantially identical configuration and dimensions.

3. The combination of claim 1 wherein said shaft has a pointed tip.

4. The combination of claim 1 wherein each of said barbs has a generally V-shaped configuration.

5. The combination of claim 4 wherein the exterior tips of said V-shaped barbs is spaced apart by a distance of between 2.5 mm and 7.5 mm.

6. The combination of claim 1 wherein said hanger is formed of a plastic material.

7. The combination of claim 1 wherein said head has an aperture extending therethrough.

8. The combination of claim 4 wherein said exterior tips of said V-shaped barbs is spaced apart by a distance of approximately 5 mm.

* * * * *